US005979704A

United States Patent [19]

Holmes et al.

[11] Patent Number: 5,979,704

[45] Date of Patent: Nov. 9, 1999

[54] BLOCKAGE COMPENSATING DISPENSE SYSTEM

[75] Inventors: Mark Holmes, Quaker Hill; Ronald E. Belek, Coventry, both of Conn.

[73] Assignee: Loctite Corporation, Hartford, Conn.

[21] Appl. No.: 08/922,703

[22] Filed: Sep. 3, 1997

[51] Int. Cl.[6] ..... B67D 5/22

[52] U.S. Cl. ..... 222/63; 222/52

[58] Field of Search ..... 222/52, 63

[56] References Cited

U.S. PATENT DOCUMENTS

| | | | |
|---|---|---|---|
| 4,894,252 | 1/1990 | Bongen et al. . | |
| 4,917,296 | 4/1990 | Konieczynski . | |
| 5,316,217 | 5/1994 | Guzowski et al. . | |
| 5,382,394 | 1/1995 | Terhardt . | |
| 5,711,483 | 1/1998 | Hays | 222/63 X |
| 5,857,589 | 1/1999 | Cline et al. | 222/63 X |

FOREIGN PATENT DOCUMENTS

| | | |
|---|---|---|
| 2638052 | 4/1990 | France . |
| 63-224758 | 9/1988 | Japan . |

*Primary Examiner*—Kenneth Bomberg
*Attorney, Agent, or Firm*—Hoffman & Baron, LLP

[57] ABSTRACT

A dispensing system detects system blockages in a delivery system due to curing or pack-out between a fluid source and a fluid dispense valve. The dispensing system automatically compensates for blockages in the delivery system by diverting fluid flow from one fluid circuit line to a parallel fluid circuit line leading to a dispensing valve.

28 Claims, 4 Drawing Sheets

BLOCKAGE COMPENSATING DISPENSE SYSTEM

FIELD OF THE INVENTION

The present invention relates generally to the field of fluid dispensing systems. More specifically, the present invention relates to a self-compensating fluid dispensing system which can be simultaneously maintained and operated.

BACKGROUND OF THE INVENTION

Adhesive is used extensively in many industries as an efficient means of joining two or more elements. In the electronics industry, for example, adhesives are particularly used for supporting components on printed circuit boards. The adhesives may additionally exhibit heat-conducting or electrical-insulation properties when the adhesive has dispersed therein small particles, or filler, which impart the desired characteristic. For example, heat conducting adhesives, which help conduct heat away from the components on a circuit board, include metallic particles dispersed therein to aid in heat transfer through the adhesive. Dielectric adhesives, which help to electrically insulate the adhered components, include small glass spheres, on the order of about 1/5000 of an inch in diameter, dispersed therein to provide sufficient spacing in the adhesive so as to disrupt electrical conduction therethrough.

Automated dispense systems ordinarily use high pressure to deliver filled adhesives through a controllable dispense valve. The dispense valve can be opened to provide the filled adhesive to the objective surface and closed when sufficient adhesive has been applied. The predominate difficulty when dispensing filled adhesives in this manner is posed by blockage of the dispensing system by the adhesive fluid. Blockages result from either the premature curing of the adhesive or the pack-out of the filler material within the delivery system.

Premature curing of the adhesive refers to the hardening or drying of the adhesive while still within the delivery system. As curable adhesives may be sensitive to time, temperature, and humidity, the adhesive may cure in the delivery system without being dispensed. Premature curing can block the flow of un-cured adhesive through the delivery system requiring a system shutdown until the cured adhesive is cleared out.

Pack-out of the filler material refers to the tendency of the filler particles to separate from the adhesive. Pack-out usually occurs when a filled adhesive is subjected to shearing stresses resulting from the filled adhesive being forced through geometrically varying delivery components, particularly at the areas where the delivery components geometrically constrict, such as at nozzles, pressure regulators, orifices, valves, hard comers, and the like. Pack-out at a pressure regulator during the static state, i.e. when the dispense valve remains closed for long periods, for example, results in pressure creep downstream of the regulator as the regulator is hampered in reducing fluid pressure in the lines. Pack-out during the dynamic state, i.e. when the dispense valve is periodically opened and closed, may occur at points of restriction and result in a diminished or inconsistent flow rate through the system. Furthermore, pack-out occurring at the dispense valve itself may cause the dispense valve to fail in an open condition and result in an uncommanded fluid dispensement.

As a result of blockages from premature curing and pack-out, the dispensing system must be shut down and cleaned of the restricting blockages. Shutting down the delivery system for such maintenance can unacceptably delay full production of the target article. Furthermore regularly scheduled maintenance alone is an insufficient safeguard as both premature curing and pack-out are neither periodic nor predictable. There is therefore a need for a curable fluid or filled-fluid delivery system that can self-diagnose indicia of premature curing and pack-out and can allow an operator to clear any blockages while minimizing the down-time resulting therefrom.

SUMMARY OF THE INVENTION

The present invention provides a dispensing system that detects system blockages due to curing or pack-out. The dispensing system of the present invention automatically compensates for blockages in the delivery system by diverting fluid flow to a parallel fluid circuit line leading to a dispensing valve.

More specifically, the present invention provides a dispensing system that automatically compensates for blockages in a fluid circuit line. The system includes a source of a filled fluid that flows under pressure. The source is connected to the inlet opening of a directional control valve. The directional control valve includes a plurality of outlet openings each of which may be positioned in fluid communication with the inlet opening. Each outlet opening is connected to a fluid circuit line. Each fluid circuit line leads to a dispensing valve. Each fluid circuit line includes, in serial communication, an automated ball valve, a pressure regulator, and a manual ball valve for pressure relief when service is required. A blockage-sensing means is located in each fluid circuit line to provide a signal corresponding to the pressure at that location in the fluid line to a valve control system. The valve control system compares the signal from the operating fluid line to predetermined high and low limits. The valve control system closes the automated ball valve in the operating line and orders the directional control valve to direct flow through a different fluid circuit line when the signal does not fall within the predetermined limits. The dispensing system allows the blocked line to be removed from the system, cleared of blockages, and replaced while the alternate line provides fluid for dispensing. The present invention thereby provides a substantially uninterrupted flow of the fluid through the dispensing system.

DETAILED DESCRIPTION OF THE INVENTION

Figure 1:
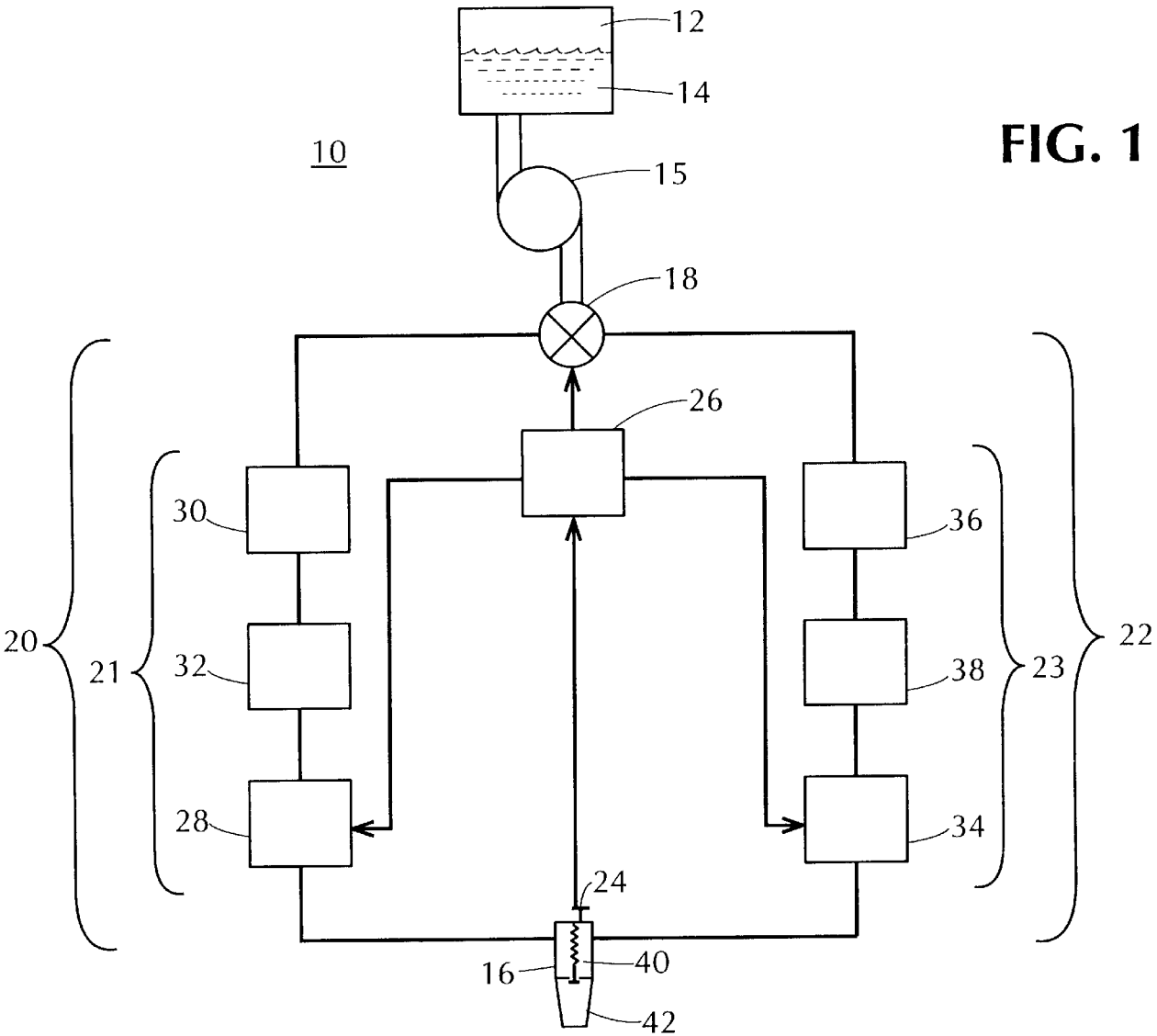
FIG. 1 is a schematic block diagram of the dispense system of the present invention.

The present invention presents a blockage-compensating dispense system 10, represented schematically in FIG. 1. Dispense system 10 includes a source 12 of a filled fluid 14 to be delivered to a dispense valve 16 for dispensing onto an article through a dispense nozzle 42 associated with valve 16. Fluid 14 is pressurized by pump 15 to flow through a directional control valve 18 which further directs fluid 14 into either a first fluid circuit line 20 or a second fluid circuit line 22. A blockage-sensing means 24 detects the pressure within dispense system 10. Blockage-sensing means 24 relays an output signal corresponding to the pressure measurement to a valve controller 26. Valve controller 26 compares the output signal to a predetermined range of acceptable output signal values. If the output signal is outside the acceptable range, indicating that the pressure in dispense system 10 is too high or too low for a given period of time, valve controller 26 commands directional control valve 18 to stop directing the fluid through the operative one of fluid circuit line 20 or 22 that is presently conducting the fluid and to start directing the fluid through the other previously non-operative fluid circuit line. The present invention may thereby provide substantially continuous dispensement of a fluid without requiring operator input to switch the selection of the operative fluid circuit line.

In the preferred embodiment, dispense system 10 allows the non-operating fluid circuit line to be disconnected between directional control valve 18 and dispense valve 16 without disrupting fluid delivery through the operating fluid circuit line. In order to regulate flow of fluid through fluid circuit lines 20 and 22 and to permit disconnection thereof for repair, operable flow controllers 21 and 23 are provided in serial fluid communication with fluid circuit lines 20 and 22, respectively. Operable flow controllers 21, 23 may include an isolation valve 28, 34, respectively, distally located from directional control valve 18. Each isolation valve 28, 34 is preferably actuated by valve controller 26 to automatically open or close as required as the operating fluid circuit line is switched. The isolation valve 28, 34 serves to both isolate the fouled circuit line and to prevent backflow of fluid 14 from operation of the other circuit line. The fouled fluid circuit line 20 or 22 may therefore be removed from dispense system 10 between directional control valve 18 and isolation valve 28 or 34, respectively, cleared of the blockage, and replaced on dispense system 10 without disrupting fluid delivery through dispense valve 16 by the alternate fluid circuit line 20, 22.

The present invention therefore provides a dispense system well suited to dispensing fluids having high concentrations of inorganic fillers, such as $Al_2O_3$. An example of such a fluid is a polymerized silicone available commercially from Loctite Corporation, Rocky Hill, Conn. under the name "LOCTITE PRODUCT 5404". The present invention also provides improved quality control of dispensed products such as thermal adhesives having thermally-conductive filler particles or dielectric adhesives having spacer materials formed of glass spheres of about 1/5000 of an inch in diameter. While the fluid to be dispensed will most likely be a silicone-based product, it could also be, by way of illustration and not by limitation, an acrylic-based fluid, an epoxy-based fluid, or a cyanoacrylate-based fluid. The fillers embodied within the fluid are typically inorganic such as, by way of illustration and not by limitation, $Al_2O_3$, zinc oxide, or nickel powder. For the present invention the concentration of the filler in the fluid is more critical than the composition itself because, whereas filled fluids desirably maximize particle to particle contact, the higher concentration of filler leads to a higher likelihood of filler pack-out.

Operable flow controller 21, 23 may also include a pressure regulator 30, 36, respectively, to reduce the pressure in the associated fluid circuit line. Ordinarily, fluid 14 is delivered through directional control valve 18 at a very high pressure, usually ranging up to about 1000 pounds per square inch (psi). It may be desirable to eventually reduce this pressure to reduce the flow rate of the fluid from dispense valve 16 or to reduce the dispensing pressures retained by dispense valve 16 down to about 300 psi or less. Pressure regulators 30, 36, which may be of the type well-known in the art, are provided to reduce the pressure in a fluid line.

If pressure regulator 30, 36 becomes fouled by the filler material of fluid 14 when the system is in the static or non-dispensing state, the fluid pressure downstream therefrom will approach the unregulated high pressure of pump 15. Therefore, the operable flow controllers 21 and 23 may also include a manual ball valve 32, 38 at a location between directional control valve 18 and isolation valve 28, 34. After directional control valve 18 and isolation valve 28, 34 have both been closed for a fouled fluid circuit line, manual ball valve 32, 38 may be opened by an operator to relieve the pressure in the fouled line prior to removing it from dispense system 10 for cleaning. Manual ball valve 32, 38 allows the operator to slowly relieve the high pressure in the fouled line so as to contain the pent-up fluid to the maximum extent possible.

It is contemplated that other operable flow controllers may be employed in combination with the present invention to initiate, monitor, regulate, or stop the flow of fluid 14 through one or the other of fluid circuit lines 20, 21. For example, instead of providing an isolation valve 28, 34 which is operable by valve controller 26, the present invention may place check valves, which only permit fluid flow towards the dispense valve, at that location instead.

The actual location and arrangement of the components of dispense system 10 may be varied depending on the particular application. The expansion or contraction of fluid 14 within the fluid circuit lines 20, 22 can be minimized by shortening the distance that fluid 14 must travel between pressure regulator 30, 36 and dispense nozzle 42. The bulk compressibility of filled fluid 14 can vary due to its gas permeability. Variations in the bulk compressibility can result in fluctuations in the flow rate through dispense nozzle 42. Some applications, such as manufacturing processes which require dispense nozzle 42 being located on a movable arm, may limit the proximity of the operable flow controllers 21, 23 to dispense nozzle 42. In these cases, for example, it may be impracticable to locate pressure regulator 30, 36 on the movable arm as well.

Figure 3:
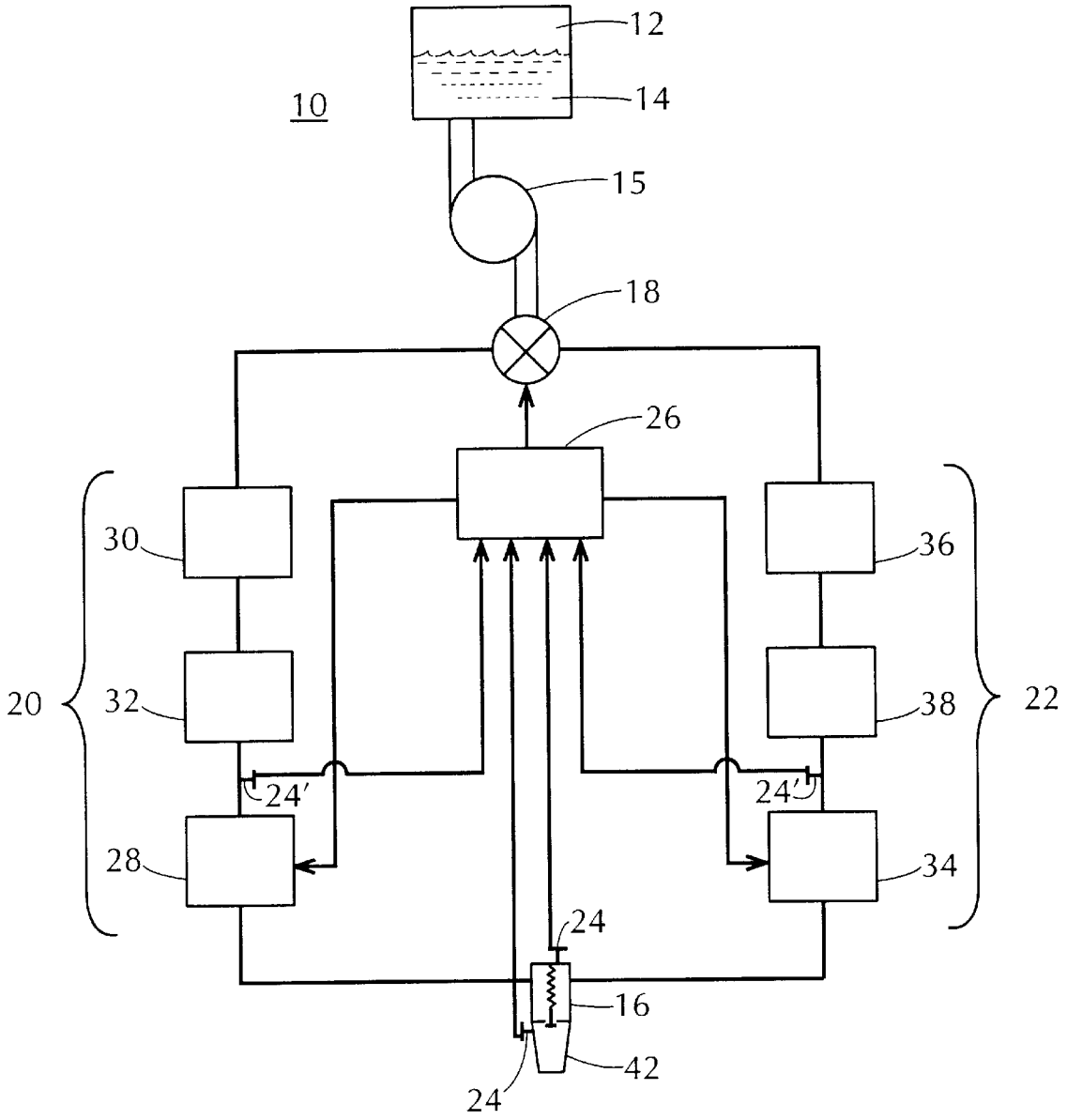
FIG. 3 is a schematic block diagram of an alternate embodiment of the dispense system of the present invention.

In the embodiment shown in FIG. 1, a single blockage-sensing means 24 is associated with both fluid circuit lines 20 and 22. It is further contemplated that more than one blockage-sensing means may be employed to monitor conditions in dispense system 10. Locating additional blockage-sensing means throughout dispense system 10 can more precisely indicate the exact location of the blockage. For example, while blockage-sensing means 24 is shown in FIG. 1 to be located adjacent the reservoir 40 of dispense valve 16, FIG. 3 shows that additional blockage-sensing means 24' may be located just downstream of pressure regulator 30, 36. Furthermore, dispense system 10 could place an additional blockage-sensing means 24' within dispense nozzle 42 to further detect blockages therein.

Figure 4:
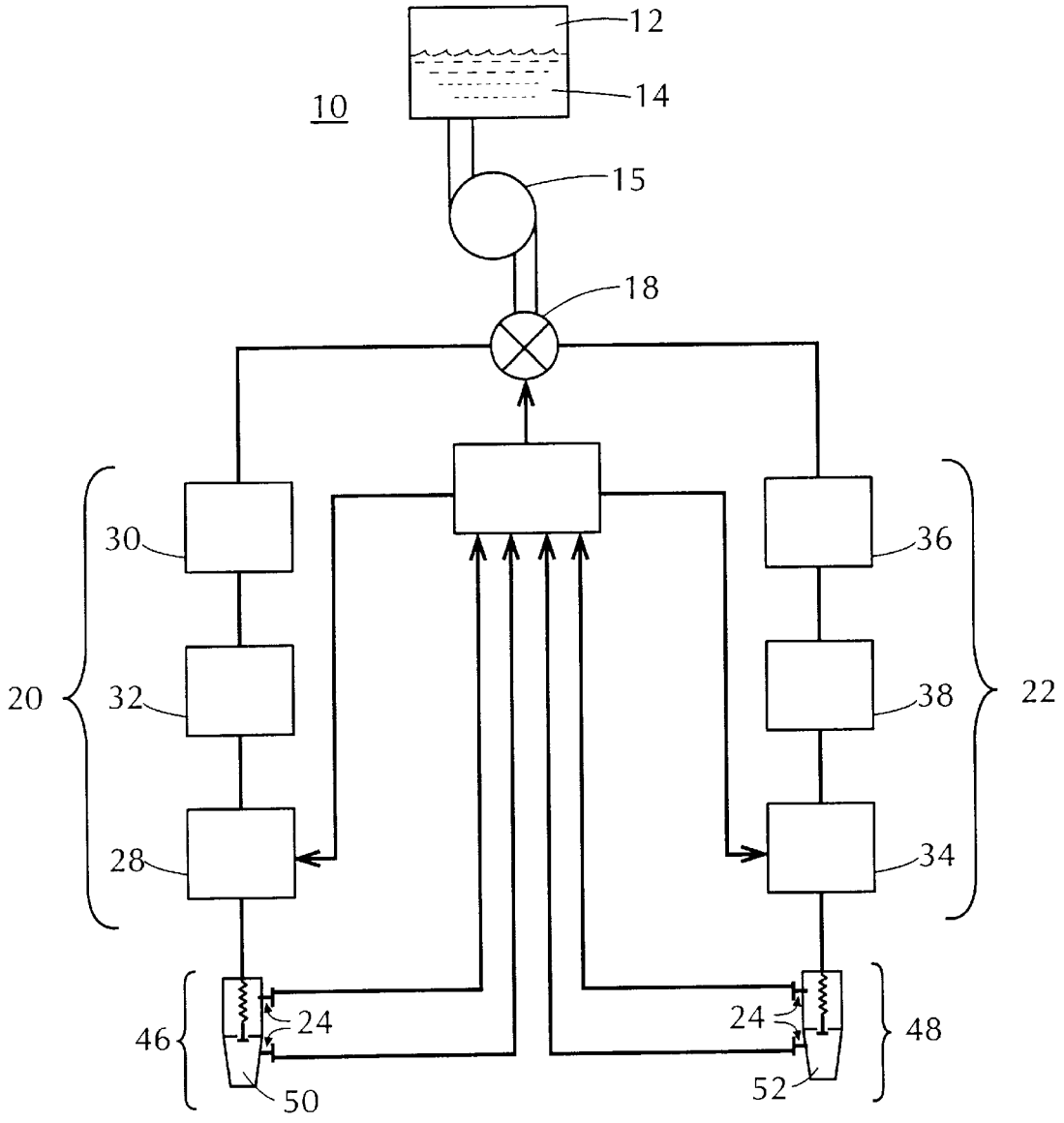
FIG. 4 is a schematic block diagram of still another dispense system of the present invention.

The present invention compensates for blockages along one of fluid circuit lines 20 and 22 by halting flow to the blocked line and initiating flow through the non-blocked line. However, should dispense valve 16 or dispense nozzle 42 become fouled, a dispense system configured as shown in FIGS. 1 and 3 would have to be shut down to clear the blockage therein. In certain applications any shut-down of the dispense system 10 would be unacceptably costly. The present invention could be configured as shown in FIG. 4 whereby each fluid circuit line 20, 22 would include its own dedicated fluid dispense valve 46, 48 and fluid dispense nozzle 50, 52.

Dispense system 10' is substantially similar to dispense system 10 of FIGS. 1 and 3 and includes a similar numbering scheme to represent similar components. Dispense system 10' includes a pair of dispense nozzles 50, 52 each individually associated with a dispense valve 46, 48 respectively. The dispense system 10' can continue to dispense fluid 14 even if one dispense valve 46, 48 or dispense nozzle 50, 52 were to become fouled. For applications where the positioning of the dispense nozzle is particularly critical, it is contemplated that dispense system 10' would provide means for spatially displacing the dispense nozzle of the fouled line with the dispense nozzle of the clear line. As directional control valve 18 can isolate each fluid circuit line 20, 22, dispense system 10' would not require an isolation valve between pressure regulator 30, 36 and dispense nozzle 46, 48, unless it were desirable to be able to remove dispense nozzle 46, 48 separately from the pressure regulator.

Valve controller 26 is configured to compare the inputs from each blockage-sensing means 24 with a predetermined range of acceptable input values. As each input preferably corresponds to the fluid pressure at a given location, valve controller 26 is thus able to monitor the fluid pressure in the operating line of fluid flow and to switch to an alternate line when a blockage is detected in the presently operating line. In order to make valve controller 26 insensitive to transient spikes in the measured pressure, which may occur immediately following the opening or closing of dispense valve 16, valve controller 26 must detect an out-of-range signal a prescribed period of time after dispense valve 16 opens or closes.

Figure 2:
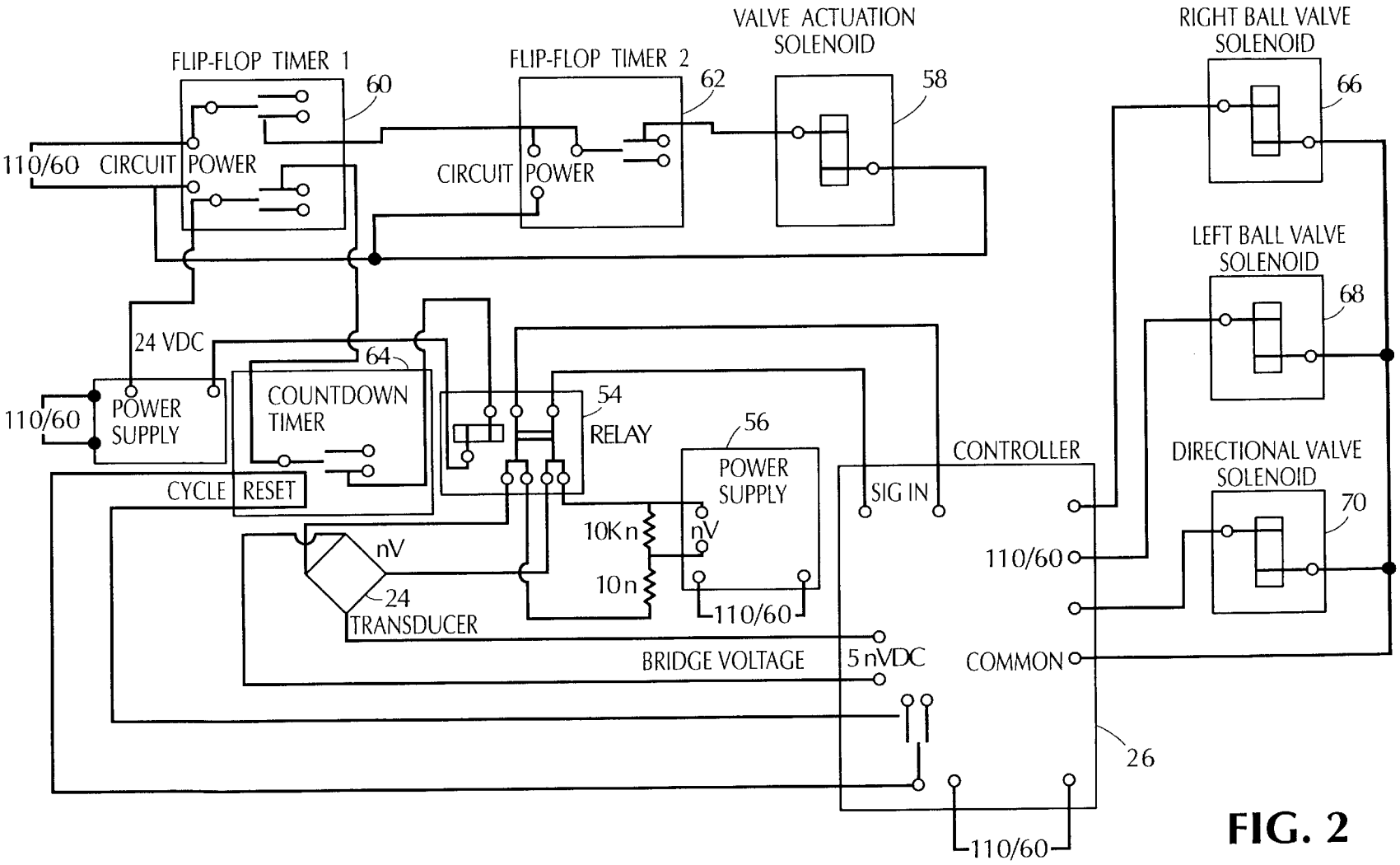
FIG. 2 is a schematic circuit diagram of the valve controller for the dispense system of FIG. 1.

The present invention will typically provide highly intermittent flow through dispense valve 16. Dispense system 10 employs a signal sampling method that takes into account the possible rise times or lag times associated with the pressure in the fluid line in response to the changing valve condition. With reference to FIG. 2, valve controller 26 receives an input signal, from relay 56, of either a fixed (or dummy) signal from power supply 58 which falls within the acceptable range of signals for maintaining fluid flow through the fluid circuit line currently selected or of a true signal corresponding to the actual pressure measured in the selected fluid line by transducer 24.

The present invention contemplates providing the fixed (or dummy) signal to valve controller 26 for a sufficient amount of time after valve 16 changes state, to either an open or closed condition, to allow the actual pressure within the selected fluid line to achieve a steady state whereby the pressure measurement provided by transducer 24 gives a true indication of the fluid line pressure. For example, prior to opening valve 16 the pressure within the selected fluid line will be at a static-state level corresponding to the output of pressure regulator 30 or 36. When valve 16 is opened, the fluid pressure in the selected fluid line will descend to a lower pressure resulting from valve 16 being open. Were the output signal from transducer 24 sampled immediately after valve 16 opened, transducer 24 would indicate a fluid line pressure that was too high for the open condition and controller 26 would erroneously interpret that signal as indicating a blockage in the selected fluid line. Similarly, when valve 16 is closed, the fluid pressure in the selected fluid line will rise from the dynamic-state level to the pressure corresponding to the output of pressure regulator 30 or 36. Were the output signal from transducer 24 sampled immediately after valve 16 closed, transducer 24 would indicate a fluid line pressure that was too low for the closed condition and controller 26 would erroneously interpret that signal as indicating a dispense valve stuck open. To prevent such erroneous interpretations, the present invention provides a dummy signal to controller 26 until the fluid line pressure has had time to achieve equilibrium.

Valve actuation solenoid 58, which controls the opening and closing of dispense valve 16, changes the state of dispense valve 16 upon receiving a signal through flip flop timers 60 and 62. Flip flop timer 60, upon sending a new signal to valve actuation solenoid 58, also commands countdown timer 64 to begin a countdown corresponding to the expected pressure equilibration time corresponding to the change in state of dispense valve 16. The pressure equilibration time delay relates to how long countdown timer 64 delays relay 54 from providing the true signal from transducer 24 to controller 26. If, after the time delay, the signal from transducer 24 is outside the range of acceptable values, controller 26 will order solenoid 66 to close the ball valve of the currently selected line, solenoid 68 to open the ball valve of the currently available line, and solenoid 70 to switch the output line of directional control valve 18 from the selected line to the available line. The previously selected line, now isolated, may then be removed from dispense system 10 for maintenance and then reconnected to become available should the other line become fouled.

While the present invention has been shown and described herein, it will be evident to those persons of ordinary skill that changes and modifications may be made without departing from the teachings of the invention. Accordingly, that which is set forth in the foregoing description and accompanying drawings is offered by way of illustration only and not as a limitation. The scope of the invention is defined by the claims.

What is claimed is:

1. A blockage-compensating fluid dispense system, comprising:

a fluid source for supplying a fluid;

dispense means for dispensing said fluid from said source;

a first fluid circuit line for conducting fluid from said source through said dispense means;

a second fluid circuit line for conducting fluid from said source through said dispense means;

blockage-sensing means for detecting blockages obstructing said conduct of fluid from said source through said dispense means; and a directional control valve responsive to said blockage-sensing means for alternatively directing fluid from said source through one of said first fluid circuit line and said second fluid circuit line, and preventing fluid from flowing through the other of said first fluid circuit line and said second fluid circuit line.

2. The dispense system of claim 1, wherein said dispense means includes a dispense valve, said dispense valve being operable between an open condition whereby said fluid is dispensed from said dispense valve and a closed condition whereby said fluid is retained in said dispense valve.

3. The dispense system of claim 2, further comprising a valve controller responsive to said blockage-sensing means for controlling said directional control valve in response to said blockage-sensing means so as to redirect said fluid through the other of said first fluid circuit line and said second fluid circuit line when said blockage-sensing means indicates a blockage in said one fluid circuit line.

4. The dispense system of claim 3, wherein said blockage-sensing means generates a signal corresponding to a fluid pressure in one of said first and second fluid circuit lines and said dispense valve.

5. The dispense system of claim 4, wherein said valve controller causes said directional control valve to redirect said fluid through said other fluid circuit line when said signal from said blockage-sensing means indicates conduct of said fluid through said one fluid circuit line is obstructed.

6. The dispense system of claim 1, wherein said directional control valve further includes a first outlet opening and a second outlet opening through which said fluid may be directed, said directional control valve selectively directing fluid through one of said first outlet opening and said second outlet opening, said directional control valve further including direction means for changing the outlet opening through which said fluid is directed in response to said blockage-sensing means.

7. The dispense system of claim 6, wherein said first fluid circuit line further comprises a first elongate hollow fluid line having a first end, a second end, and a tubular member extending therebetween so that said first end and said second end are in fluid communication, said first end of said first fluid line being in disconnectable fluid communication with said first outlet opening of said directional control valve.

8. The dispense system of claim 7, wherein said first fluid circuit line is connected to a first line pressure regulator.

9. The dispense system of claim 7, wherein said first fluid circuit line is connected to a first line manual ball valve.

10. The dispense system of claim 7, wherein said first fluid circuit line is in serial fluid communication with a first line actuator-controlled ball valve.

11. The dispense system of claim 10, wherein said first line actuator-controlled ball valve is further located in serial fluid communication between a first line pressure regulator and said dispense means.

12. The dispense system of claim 11, wherein said first line actuator-controlled ball valve is closed by said valve controller prior to said directional control valve directing said fluid through said second fluid circuit line.

13. The dispense system of claim 12, wherein said second fluid circuit line further comprises a second elongate hollow fluid line having a first end, a second end, and a tubular member extending therebetween so that said first end and said second end are in fluid communication, said first end of said second fluid line being in disconnectable fluid communication with said second outlet opening of said directional control valve.

14. The dispense system of claim 13, wherein said second fluid circuit line is connected to a second line pressure regulator.

15. The dispense system of claim 13, wherein said second fluid circuit line is connected to a second line manual ball valve.

16. The dispense system of claim 13, wherein said second fluid circuit line is in serial fluid communication with a second line actuator-controlled ball valve.

17. The dispense system of claim 16, wherein said second line actuator-controlled ball valve is further located in serial fluid communication between a second line pressure regulator and said dispense means.

18. The dispense system of claim 16, wherein said second line actuator-controlled ball valve is closed by said valve controller prior to directing said fluid through said first fluid circuit line.

19. The dispense system of claim 1, wherein said blockage-sensing means is a pressure transducer.

20. The dispense system of claim 1, wherein said blockage-sensing means is located upstream of said dispense means.

21. The dispense system of claim 1, wherein said dispense means further comprises a first dispense apparatus and a second dispense apparatus, said first fluid circuit line terminating at said first dispense apparatus, said second fluid circuit line terminating at said second dispense apparatus, wherein said first dispense apparatus is independent of said second dispense apparatus.

22. The dispense system of claim 1, further comprising an additional blockage-sensing means positioned downstream of said dispense valve and generating a second signal corresponding to a fluid pressure downstream of said dispense valve, said valve controller receiving said second signal from said additional detection means and providing to said directional control valve a command to halt fluid flow through any fluid circuit lines when said signal indicates fluid pressure at said dispense valve varies from a predetermined range of acceptable values.

23. The dispense system of claim 1, wherein said fluid is an adhesive.

24. The dispense system of claim 23, wherein said adhesive is a filled adhesive.

25. The dispense system of claim 24, wherein said adhesive is selected from the group consisting of silicone-based adhesives, acrylic-based adhesives, epoxy-based adhesives, and cyanoacrylate-based adhesives.

26. The dispense system of claim 24, wherein said filled adhesive includes an inorganic filler material.

27. The dispense system of claim 24, wherein said filled adhesive includes a filler material selected from the group consisting of $Al_2O_3$, zinc oxide, and nickel powder.

28. A blockage compensating dispense system, comprising:

a directional control valve having an inlet port, a first outlet port, and a second outlet port, and means for selectively positioning one of said first and second outlet ports in fluid communication with said inlet port;

a valve control device controlling the selective positioning of said first and second outlet ports;

a first elongate hollow fluid line having a first end, a second end, and a tubular member extending therebetween so that said first end and said second end are in fluid communication, said first end of said first fluid line being in disconnectable fluid communication with said first outlet port of said directional control valve, a first line pressure regulator;

a first line actuator-controlled ball valve, and a first line manual ball valve, said first fluid line being in serial communication with said first line pressure regulator, said first line actuator-controlled ball valve, and said manual ball valve;

a second elongate hollow fluid line having a first end, a second end, and a tubular member extending therebetween so that said first end and said second end are in fluid communication, said first end of said second fluid line being in disconnectable fluid communication with said second outlet port of said directional control valve, a second line pressure regulator;

a second line actuator-controlled ball valve, and a second line manual ball valve, said second fluid line being in serial communication with said second line pressure regulator, said second line actuator-controlled ball valve, and said manual ball valve;

a fluid dispensing valve having a first inlet port, a second inlet port, a dispensing port, and a valve registering with said dispensing port and movable between an open condition allowing fluid to pass through said dispensing port and a closed condition preventing fluid from passing through said dispensing port, said first fluid line being in disconnectable fluid communication with said first inlet port, said second fluid line being in disconnectable fluid communication with said second inlet port, said dispensing port being in selectable communication with one of said first inlet port and said second inlet port; and a pressure transducer positioned at a location in communication with one of the group consisting of said first fluid line, said second fluid line, and said fluid dispensing valve;

said pressure transducer generating an electrical signal corresponding to the pressure of said fluid at said location, said transducer transmits said signal to said valve control device, said valve control device selectively changing the outlet port in communication with said directional control valve inlet when said signal does not correspond to a predetermined range of acceptable signal values.

* * * * *

UNITED STATES PATENT AND TRADEMARK OFFICE

CERTIFICATE OF CORRECTION

PATENT NO. : 5,979,704

DATED : November 9, 1999

INVENTOR(S) : Holmes, M.; Bleck, R.E.

It is certified that error appears in the above-identified patent and that said Letters Patent is hereby corrected as shown below:

At column 1, line 53, the printed patent incorrectly reads "valves, hard comers, and the like."; the patent should read –valves, hard corners, and the like.–.

Signed and Sealed this

Twenty-fifth Day of July, 2000

*Attest:*

*Attesting Officer*

Q. TODD DICKINSON

*Director of Patents and Trademarks*